US009908658B2

(12) United States Patent
Jouin et al.

(10) Patent No.: US 9,908,658 B2
(45) **Date of Patent: *Mar. 6, 2018**

(54) LIQUID FILLED BOTTLE HAVING A THIN COVER MEMBER PROVIDED WITH A FLEXIBLE REINFORCING ELEMENT

(71) Applicants: SA DES EAUX MINERALES D'EVIAN SAEME, Evian les Bains (FR); COMPAGNIE GERVAIS DANONE, Paris (FR)

(72) Inventors: Frederic Jouin, L'Haye les Roses (FR); Christine Gehringer, Vinzier (FR); Jennifer Ostertag, Evian les Bains (FR)

(73) Assignees: SA DES EAUX MINERALES D'EVIAN SAEME, Evian-les-Bains (FR); COMPAGNIE GERVAIS DANONE, Paris (FR)

( * ) Notice: Subject to any disclaimer, the term of this patent is extended or adjusted under 35 U.S.C. 154(b) by 81 days.

This patent is subject to a terminal disclaimer.

(21) Appl. No.: 14/778,893

(22) PCT Filed: Apr. 10, 2014

(86) PCT No.: PCT/EP2014/057324

§ 371 (c)(1),
(2) Date: Sep. 21, 2015

(87) PCT Pub. No.: WO2014/170215

PCT Pub. Date: Oct. 23, 2014

(65) Prior Publication Data

US 2016/0046402 A1 Feb. 18, 2016

(30) Foreign Application Priority Data

Apr. 15, 2013 (WO) ..... PCT/IB2013/000998

(51) Int. Cl.
*B65D 1/02* (2006.01)
*B65D 77/20* (2006.01)

(52) U.S. Cl.
CPC ..... *B65D 1/0253* (2013.01); *B65D 1/02* (2013.01); *B65D 1/0246* (2013.01); *B65D 77/2024* (2013.01); *B65D 2577/205* (2013.01)

(58) Field of Classification Search
CPC ..... B65D 51/245; B65D 23/14; B65D 3/12; B65D 1/0246; B65D 77/2024
(Continued)

(56) References Cited

U.S. PATENT DOCUMENTS 5,226,281 A * 7/1993 Han ..... B65D 77/2032 156/69
6,296,137 B1 * 10/2001 Bjørnsen ..... B65D 23/12 220/257.2
2005/0189351 A1 * 9/2005 Clarke ..... B65D 51/145 220/212

(Continued)

FOREIGN PATENT DOCUMENTS

DE 20 2008 010071 U1 12/2008
EP 0 761 560 A1 3/1997

(Continued)

OTHER PUBLICATIONS

International Search Report dated Jun. 18, 2014 in corresponding PCT application.

*Primary Examiner* — Anthony Stashick
*Assistant Examiner* — Raven Collins
(74) *Attorney, Agent, or Firm* — Young & Thompson

(57) ABSTRACT

The plastic bottle (1) is filled with liquid and provided with a rigid neck (4) that defines a narrow opening (5) with an inner diameter (D5) typically inferior to 40 mm. A flexible sheet-like cover member (C), having a lower closing element and an upper reinforcing element, is provided to seal the opening. A reinforcing portion (10) of the reinforcing element (C2) is directly fastened to a central portion (6) of the closing element in contact with the annular upper face (Continued)

(F) of the neck and reinforces this central portion. A first surface (S1) suitable for displaying label information is defined by the reinforcing portion. The outer rim (8) of the reinforcing element extends along or close to a rim (4*d*) of the face (F). An optional pull tab (9) forming part of the closing element (C1) and/or an extension portion forming part of the reinforcing element (C2) may be provided.

18 Claims, 5 Drawing Sheets

(58) Field of Classification Search
USPC ..... 215/230, 42; 220/359.1, 359.2
See application file for complete search history.

(56) References Cited

U.S. PATENT DOCUMENTS

| | | | | |
|---|---|---|---|---|
| 2005/0247713 | A1* | 11/2005 | Niederer | B65D 77/2032 220/359.2 |
| 2008/0073308 | A1 | 3/2008 | Yousif | |
| 2009/0212060 | A1 | 8/2009 | Shinohara et al. | |
| 2011/0152821 | A1* | 6/2011 | Kornfeld | B32B 3/266 604/403 |

FOREIGN PATENT DOCUMENTS

| | | | |
|---|---|---|---|
| GB | 1536428 | | 12/1978 |
| JP | 2-99765 | U | 8/1990 |
| JP | 2000-219789 | A | 8/2000 |
| WO | 2012/168471 | A1 | 12/2012 |
| WO | 2013/092529 | A1 | 6/2013 |

* cited by examiner

LIQUID FILLED BOTTLE HAVING A THIN COVER MEMBER PROVIDED WITH A FLEXIBLE REINFORCING ELEMENT

FIELD OF THE INVENTION

The present invention relates to containers provided with a neck and a narrow opening defined in the upper face of the neck and having a cover member for sealing the narrow opening, such as plastic bottles or similar containers used in food or non food packaging industry.

BACKGROUND OF THE INVENTION

In bottles of this type (of the International class B65D 1/02 according to the International Classification), the opening defined in the upper face of the neck must be sufficiently narrow for precisely pouring the liquid contained in the bottle and limiting risk of contamination. Other containers having a large opening such as cups, cylindrical recipients and containers having a general U or V-shape in cross-section are not adapted for such a purpose. Furthermore, risks of breakage at the opening during transport are higher with containers provided with apertures as wide as the body of the container. The invention does not relate to that category of containers but rather concerns containers with restricted apertures, which are typically sold with a flowable product inside and having a removable lid for sealing the aperture.

In order to obtain pouring convenience for the user, even when pouring the liquid into a cup of small capacity (typically less than 300 mL), the largest dimension of the narrow opening is generally inferior to 40 mm and typically inferior to 30 mm. Accordingly, a narrow opening means in the present specification an opening having its largest dimension inferior to 40 mm. Such a narrow opening is especially well adapted for direct drinking or for pouring the content of the bottle in a water cup having a maximum diameter inferior to 80 mm.

Bottles of this type also have to satisfy various constraints associated with their transport while having to be as light as possible in order to reduce costs associated with the quantity of plastic material used or with its transportation, and to reduce the impact on the environment. The food industry in particular has to propose packagings inexpensive and which generate as less as possible wastes.

Document EP 0 761 560 A1 discloses a glass or plastic receptacle whose neck is closed by a rectangular capsule and comprises an outer thread allowing use of a screw cap. The rectangular capsule comprises a closing portion heat sealed onto a ring defined at the top of the neck and having a disk-like shape. In the respective corners of the rectangular capsule, two tips are folded along the neck and fixed by heat sealing, while two other tips extend in the same plane as the closing portion and may be used to remove the capsule. Receptacles such a those disclosed in EP 0 761 560 A1 are provided with a sleeve label arranged around the body of the receptacle to display information about the content to the user.

Such receptacles still contain a significant amount of plastic material. A need thus still exists for developing liquid filled bottles with less plastic material and/or optimizing the use of plastic material in such sealed receptacles, and/or simplifying manufacturing processes.

SUMMARY OF THE INVENTION

A general object of the present invention is to provide liquid filled bottles having a narrow opening (the largest dimension thereof being typically inferior to 40 mm) with an improved use of the plastic material.

To this end, embodiments of the present invention provide a liquid filled bottle, comprising a cover member and a plastic bottle having a body, a rigid neck and a narrow opening sealed by the cover member, the narrow opening being defined in the upper face of the neck and surrounded by a ring of the neck, the cover member comprising:

a one piece flexible closing element consisting essentially of a peelable film and comprising:

i) a central portion adhering with said ring and sealing the narrow opening of the bottle, and ii) optionally at least one margin portion extending around the central portion;

a one piece flexible reinforcing element defined by at least one layer of film material;

wherein the closing element has a top face delimited by a circumference and defining a substantially planar support surface;

wherein the reinforcing element comprises a reinforcing portion directly fastened to all or a part of said support surface and which entirely or partly covers said central portion, with the provision that at least an annular fixing portion covering the ring is covered by the reinforcing element, the reinforcing portion defining a first surface, optionally comprises an extension portion defining a second surface that is entirely offset relative to the upper face of the neck, with the provision that if the reinforcing element comprises the extension portion then the ratio between the second surface and the first surface is lower than 1:2.

The bottle has a narrow opening. By narrow opening, it is meant that the dimension of the opening is lower than the largest dimension of the body cross-section and preferably lower than the smallest dimension of the body cross-section and/or that the dimension of the opening is inferior to 40 mm, preferably inferior to 30 mm. It is understood that the height of the body is significantly greater than the size (typically a diameter) of the opening, preferably at least twice as large as the opening size.

The reinforcing element creates an additional layer of material, which stiffens and reinforces the central portion that adheres on the ring defining the narrow opening. The fact that a reinforcing element is bonded to the flexible film forming the closing element, by a layer of adhesive or possibly by a heat sealing bond, and not merely arranged against the inner side of an additional cap, provides a reinforcing effect. This reinforcing effect creates an area which remains more flat, and which is less subject to form waves or to crumple, even said area by the aperture is not made rigid. Moreover it improves the integrity of the cover member which can tear upon application of a sudden pressure, such as pressure applied when a bottle drops. This is of particular interest since narrow openings are subject to such pressures. It has been surprisingly found that tearing in such conditions can be suppressed. It should be noted that the fact of using a film-like or band device, that is to say one or several relatively thin elements, made of flexible material has advantages regarding the manufacturing and filling process of the packaging. In particular there is no need for an additional cap and no screwing is required in such a process using a plastic bottle.

The cover member is made of plastic material and it is understood that at least the flexible closing element is a plastic film (i.e. not including any mineral foil such as a metal foil). Such metal-free film can be transparent and may comprise one sealant film of PET or similar plastic film, optionally with a lacquer-like coating. The solution with a specific and relatively small reinforcing portion (arranged in the area corresponding to the ring of the neck) provides a better seal of the closing element, without use of any complex composition for the film-like elements.

The fact that the neck of the plastic bottle is rigid (without any flexibility) also appears important for improving the seal while keeping a narrow opening. The annular margin portion preferably defines a circumferentially continuous protection around the annular sealing area and prevents in particular migration from adhesive material or the like from the reinforcing element to the sealing portion.

Advantageously, the cover member made of plastic material is provided for sealing the bottle and also for displaying information using at least the front face of the cover member, whereby the sleeve label becomes optional. The manufacturing process can be simplified, as the step of applying the sleeve can be omitted. As the size of the reinforcing element is not too different from the size of the ring, saving of plastic material is also obtained. Indeed, the outer rim of the reinforcing element extends annularly close to the ring.

For bottles of small capacity (for instance between 150 mL and 500 mL), the label information can be easily read when the bottle is taken by hand in the gripping portion, while information displayed on a conventional sleeve label is masked by the hand. Furthermore, the neck may be of reduced height, without any thread. The height of the neck thus may be inferior or equal to 10 mm for instance.

According to a particular feature, the outer rim of the reinforcing element has a length inferior to the circumference of the closing element, and preferably it extends within the limits of this circumference. With such an arrangement, the first surface may be inferior or equal to the support surface, thus minimizing the amount of material in this reinforcing portion.

According to a particular feature, the outer rim of the reinforcing element is continuously rounded or at least continuously rounded in a half of the reinforcing element at the opposite from the extension portion. Such a rounded shape may correspond to the annular shape of the ring and amount of material is optimized.

According to another particular feature, the reinforcing element defines a label with label information displayed on the first surface which corresponds to an upper face of the reinforcing element, and/or on an additional surface which corresponds to a lower face of the reinforcing element. The user thus can read additional information after removal of the cover member. When the closing element is transparent, there is no need to add a protruding portion for displaying such additional information.

According to a particular feature, the closing element comprises a pull tab adapted for removing the cover member from the ring of the neck, the pull tab protruding radially outwards beyond said ring and being preferably not covered by the reinforcing element. With such an arrangement, the pulling action does not directly interfere with displaying of information through the reinforcing portion. This pull tab can be easily bent (no stiffening effect due to the reinforcing element), what is advantageous to prevent accidental removal of the cover member. Unlike sealing membranes used in yogurt containers or similar containers having a non restricted aperture, the closing element can be removed faster and even a young child can easily remove the cover member as a whole because the dimensions of the narrow opening are not great as compared to the radial extension of the pull tab (such radial extension being the sum of the width of the ring and the distance between the free end of the pull tab and the outer edge of the ring). For instance the ratio between the diameter of the opening and the radial extension of the pull tab may be more than 1:6 and preferably between 1:4 and 1:1.

According to another particular feature, the body of the bottle extends around a longitudinal axis and the narrow opening is circular and provided with an inner diameter, the pull tab comprising a free end and the distance between this free end and the longitudinal axis being inferior to said inner diameter. The closing element preferably intersects the longitudinal axis. This configuration with a reduced length of the pull tab is advantageous to prevent accidental removal of the cover member.

According to another particular feature, the pull tab defines a top surface which is entirely offset relative to the upper face of the neck, the ratio between the top surface and the first surface being inferior to 1:3 and superior to 1:15. Such top surface may be used for label information. A coloured and opaque top surface may be optionally provided at a distance from the transparent central portion of the closing element.

In various embodiments of the bottle of the invention, recourse may optionally also be had to one or more of the following dispositions:

- each of the closing element and the reinforcing element is a plastic film.
- the reinforcing element defines a substantially disc-shaped crown having a determined diameter, the pull tab comprising an outer edge having a length superior or equal to one half of the determined diameter.
- the closing element is a peelable film having a maximal thickness inferior or equal to 300 μm, and the thickness is preferably constant; this maximal thickness is comprised between 5 and 200 μm for instance, and preferably between 10 and 100 μm, and even more preferably between 20 and 50 μm.
- the neck has a tubular shape and comprises an outer face extending downwardly from the ring, the ring protruding radially outwards from the outer face (the outer diameter defined by the ring being inferior to a diameter of the body).
- the neck has a tubular shape and comprises an inner face extending downwardly from the ring, the ring comprising an annular projection that protrudes radially toward the longitudinal axis from the inner face of the neck, the narrow opening having a size reduced by this annular projection (with such an arrangement, the annular fixing portion may be advantageously increased, without any impact on the external shape of the bottle).
- the reinforcing element has a thickness inferior or equal to 100 μm and preferably superior to the thickness of the closing element.
- the reinforcing element is marked with at least one of ink printing and engraving on said first surface, whereby the reinforcing portion displays label information.
- the reinforcing element is marked with ink printing on two second surfaces defined on two respective opposite faces of the reinforcing portion.
- the bottle is obtained by stretch-blow molding an injection-molded preform, the body being connected to the rigid neck of the bottle by a flexible shoulder.
- the liquid filled bottle comprises one label defined by the reinforcing element, the body being transparent and not covered by any additional layer of material.
- the central portion of the closing element is fixed on the ring of the neck by heat sealing.

the bottle can be a 150 mL, 200 mL, 250 mL, 330 mL, 500 mL, 750 mL, 1 L or 1.5 L bottle.

the bottle material can be a PolyEthylene Terephtalate (PET) material.

the closing element and/or the reinforcing element can comprise a PET material, for example a PET film optionally covered by a lacquer.

the bottle material can be a PolyEthylene Terephtalate (PET) material with each of the closing element and the reinforcing element comprising a PET material, for example a PET film optionally covered by a lacquer (using PET materials for the bottle and the cover member allows a simplified recycling).

the reinforcing element and the closing element are each cut before the sealing operation, and the reinforcing element is fastened to the closing element after marking label information and preferably before the sealing operation to seal the opening of the bottle.

the bottle may be filled with a liquid beverage, for instance a still liquid beverage and preferably mineral water.

DETAILED DESCRIPTION OF EMBODIMENTS

Figure 1:
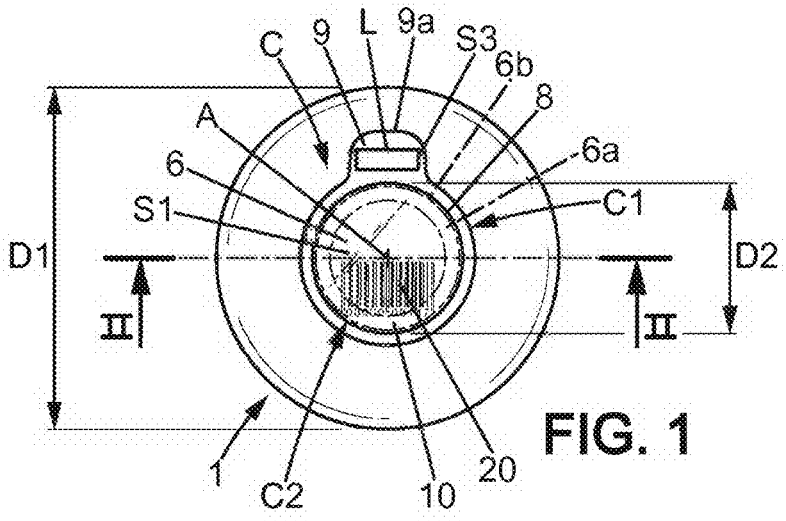
FIG. 1 is a top view of a liquid filled bottle in accordance with a first embodiment of the invention.

In the various figures, the same references are used to designate identical or similar elements.

Referring to FIGS. 1-5, the liquid filled bottle comprises a bottle 1 having a bottom 2 from which a body 3 extends longitudinally along a longitudinal axis A to a neck 4 which ends in a ring 4*a* forming a pouring opening 5. The body 3 has, from its base to its top, the bottom 2, a lower portion 3*a*, a gripping portion 3*b* and an upper portion 3*c* forming a shoulder of the bottle 1. The neck 4 is arranged as an extension of the upper portion 3*c* and here also extends longitudinally around the longitudinal axis A. This configuration is preferred because this prevents risks of breakage at the neck area during transport and the bottles 1 can be packaged with minimized empty spaces between them. Here, the body 3 has a tubular shape with a substantially circular cross-section and the longitudinal axis A may be a vertical central axis. However, it should be understood that other shapes may be provided and the neck 4 could be offset with respect to the longitudinal axis A or provided as a lateral extension of the body 3. The neck 4 is covered by a cover member C having a closing element C1. It can be seen in FIGS. 2-4 that the cover member C is a flexible sheet-like lid, the closing element C1 being a lower element of the cover member C.

In a non illustrated variant, the body 3 has a generally squared cross-section, inscribed in an imaginary encasing body that corresponds to a cylinder. The narrow opening 5 is preferably circular but any other suitable shape could be used. For instance, the narrow opening 5 could be triangularly shaped to form a spout.

Figure 5:
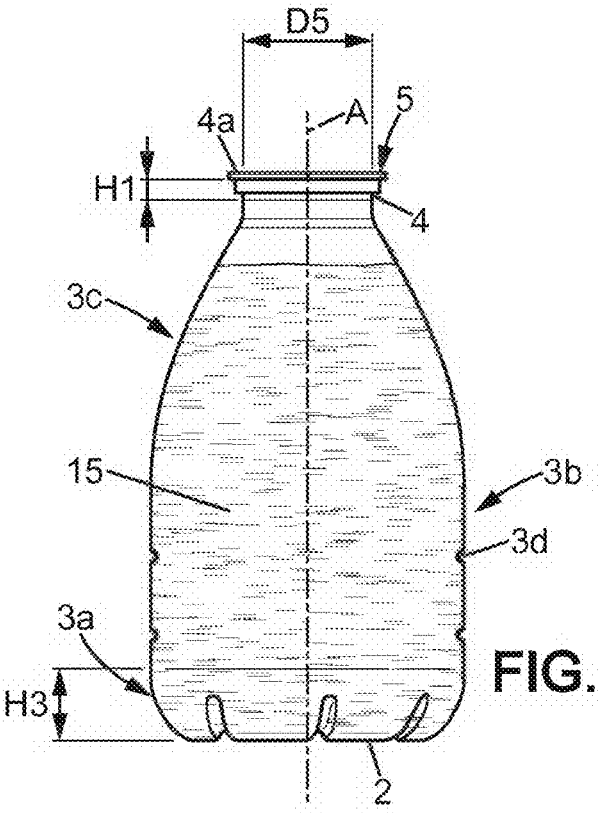
FIG. 5 shows a transparent plastic bottle filled with the liquid, before sealing by the cover member, the plastic bottle being adapted to be used in accordance with the first embodiment of the invention.

For comfortable pouring of the liquid 15 with a bottle 1 of more than 1-liter capacity, it is preferable if the gripping portion 3*b* is located above half-height of the bottle 1 but below three quarters of its total height, as shown in FIG. 5. The narrow opening 5 has a diameter D5 inferior to 30 mm (it can be seen that the neck diameter is significantly lower than the body diameter). For bottles of lower capacity, height H3 of the lower portion 3*a* may be reduced. Here, the gripping portion 3*b* has a form of a cylinder, while the upper portion 3*c* is tapered toward the neck 4. The height H1 of the neck 4 is inferior to 10 mm. Referring to FIG. 5, the height H1 of the neck 4 is inferior to 10% of the total height of the bottle 1, whose capacity is here comprised between 150 and 400 mL.

In this case, the bottle 1 may be formed from a single piece of plastic material, PET in the embodiment shown, which is shaped by heat blow-molding a preform in a mold. Heat blow-molding makes it possible to stretch the plastic material biaxially and to provide it with rigidity. Heat blow-molding also makes it possible to reduce the thickness of the wall of the body 3 considerably in relation to the thickness of the wall of the preform. This small thickness of the walls of the body 3 of the bottle 1, which may be of the order of 100 to 300 micrometers depending on the zone considered, is important for achieving a saving in material and therefore in weight.

The long shape of the body 3 may be obtained by a stretch blow molding process. The neck 4 is a rigid part present on the preform, which part is not modified during the operations of transforming the preform into a bottle 1.

Still referring to FIGS. 1-4, the neck 4 is here provided without any thread and thus can be of reduced height. The neck 4 can be closed by a film or similar thin layer of a flexible material, using a fixing material (layer of adhesive) deposited on the top annular surface defined by the ring 4*a* and/or using heat sealing, or deposited on the film.

Now referring to FIGS. 1, 3, 4 and 7, the liquid filled bottle 1 is provided with a cover member C having a closing element C1 made from a film material and a reinforcing element C2 defined by at least one layer of film material. A label may be optionally defined by the reinforcing element C2 that is not in direct contact with the neck 4. A preferred film material is PET for the closing element C1. Same material and/or PP (polypropylene) and/or PE (polyethylene) can be used for the reinforcing element C2 that is optionally provided with label information. The closing element C1 (as shown on the middle part of FIG. 4 or FIG. 7) is provided with a central portion 6 that covers the ring 4*a* to seal the narrow opening 5. The central portion 6 of the closing element C1 adheres with said ring 4*a* at an annular fixing portion 6*a*. The central portion 6 is here defined as the part extending within the limits of the annular fixing portion 6*a* and has a size larger than the opening 5 to entirely cover this narrow opening 5.

As the ring 4*a* protrudes radially outwards from the outer face of the neck 4, it is understood that the width (i.e. the radial extension) of the annular fixing portion 6*a* may be superior or equal to 1.5 or 2 mm for a bottle 1 of reduced capacity, for instance not superior to 500 mL. The fixing of the cover member C thus can be improved and risks of breakage are prevented.

Figure 2:
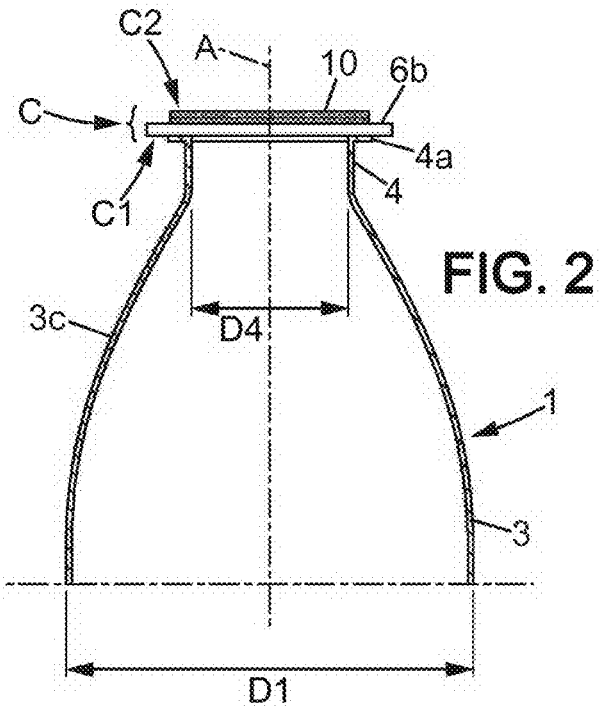
FIG. 2 is a vertical cross-section view taken through the bottle of FIG. 1.
Figure 7:
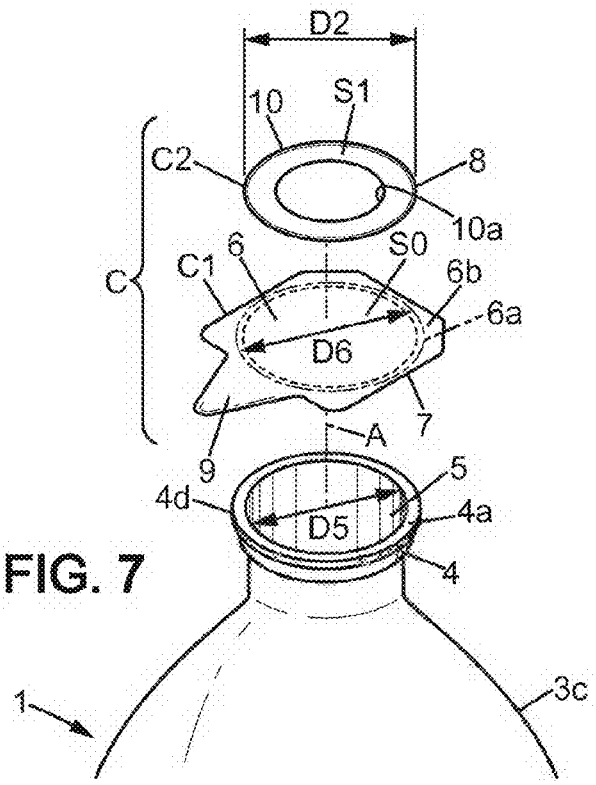
FIG. 7 is an exploded view in perspective showing the upper part of the bottle in a variant as compared to FIG. 4.

Referring to the FIGS. 1-2 and 7, it can be seen that the bottle 1 has a diameter D1 at least twice higher than the diameter D4 (inner diameter of the neck 4).

Figure 4:
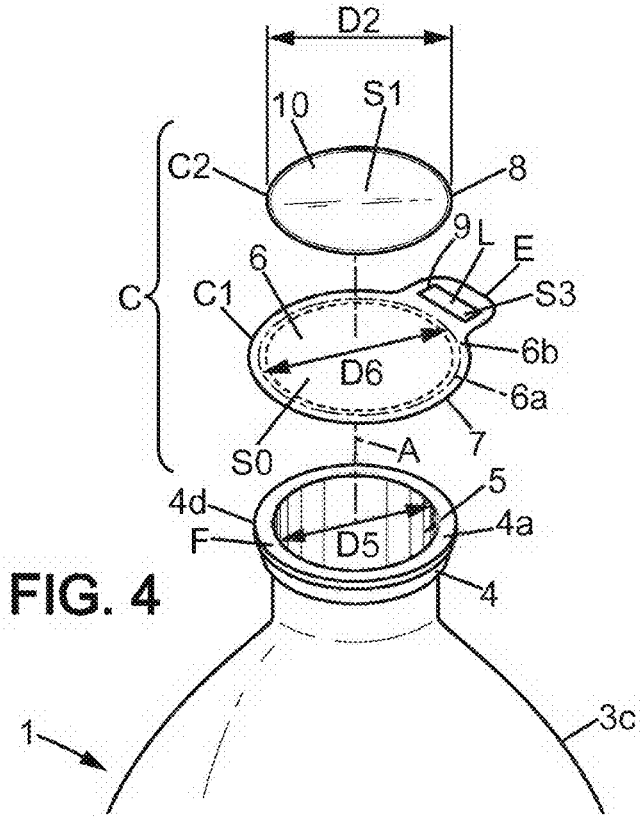
FIG. 4 is an exploded view in perspective showing the upper part of the bottle of FIG. 1.

Referring to the FIGS. 4 and 7, the opening 5 has a general circular shape. The inner diameter D5 of the opening 5 is inferior to the diameter D6 or similar characteristic dimension of the central portion 6 (see FIG. 5). While the narrow opening 5 and the central portion 6 have been illustrated as circular in the figures, it should be understood, that any other shape can be used, for instance an oval or oblong shape. Preferably, the outer rim of the closing element C1 is continuously rounded on more than 50% of the circumference 7 and has no sharp edge. The outer rim of the reinforcing element C2 may be entirely rounded and have a generally circular outer shape (as the ring 4*a* in the exemplary embodiments of FIGS. 4 and 7).

The closing element C1 is peelable and thus adapted for removal of the cover member C taken as a whole. Pulling a peripheral portion or any suitable extension of a margin portion 6*b*, here a pull tab 9, of the closing element C1 allows removing the central portion 6 from the ring 4*a*. In this example, the cover member C has a symmetry plane, which includes the longitudinal axis A, intersecting the pull tab 9. The pull tab 9 is provided with a free end 9*a* that may be not covered by the reinforcing element C2. It can be seen that the pull tab 9 radially protrudes beyond the ring 4*a* and beyond a perimeter of the reinforcing element C2.

Figure 3:
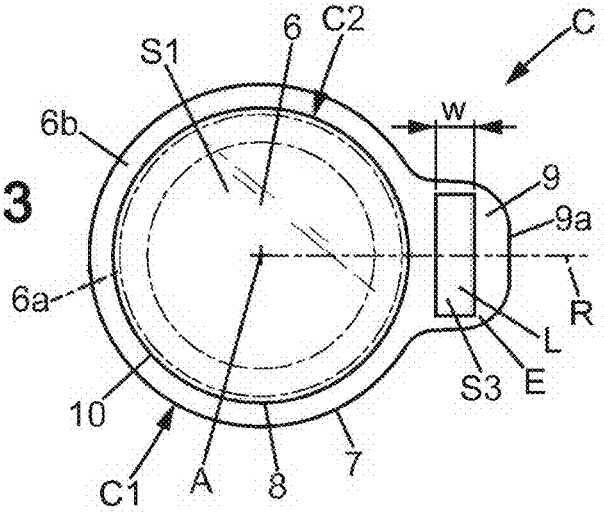
FIG. 3 is a top view of the cover member of FIG. 1.

In the first embodiment of FIGS. 1-4, a single pull tab 9 is arranged at an angular position determined with respect to the longitudinal axis A as shown in FIG. 1. The general direction according to which the pull tab 9 protrudes radially outwards as shown in FIG. 3 is hereafter called radial direction R. It can be seen that the outer rim of the reinforcing element C2 has a length inferior to the circumference 7 of the closing element C1. Preferably, this outer rim extends within the limits of (i.e. does not extend beyond) the circumference 7 of the closing element C1. With such arrangement, the upper reinforcing element C2 cannot be directly grasped and removal of the cover member C is permitted by tearing the pull tab 9 of the closing element C1 that is easy identified by the user. This is advantageous to ensure quick and efficient opening of the liquid-filled bottle.

Referring to the examples of FIGS. 1 and 3-4, one or more margin portions 6*a* extend around the central portion 6. The closing element C1 has here a circumference 7 entirely defined by a single margin portion 6*b* that continuously surrounds the central portion 6. The circumference 7 can be substantially defined by the outer edge of this annular margin portion 6*b*. Here, the margin portion 6*b* is superimposed to the outer edge of the ring 4*a* and is provided with the pull tab 9 that protrudes radially outwards relative to the neck 4 and is adapted for removing the cover member C from the ring 4*a*. As shown in FIG. 2, other parts (not only the pull tab 9) may also slightly protrude radially outwards beyond the ring 4*a*. It is thus understood that the pull tab 9 is only an option.

The closing element C1 has a top face delimited by the circumference 7 and defining a substantially planar support surface S0, as shown in FIG. 4. The flexible reinforcing element C2 is provided with a reinforcing portion 10 directly fastened to the support surface S0 and covering all or part of the central portion 6. Here, the central portion 6 is entirely covered by the reinforcing portion 10.

Figure 6:
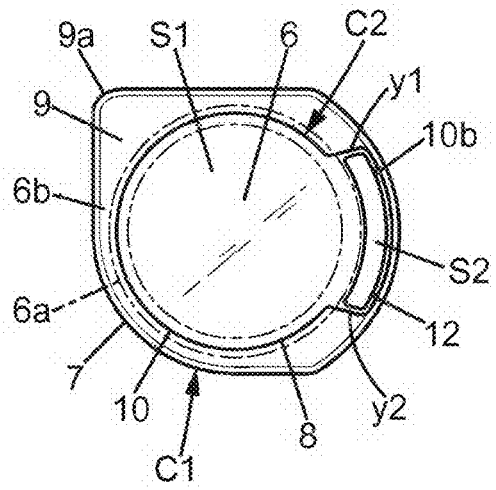
FIG. 6 is a top view of a cover member covering a liquid filled bottle in accordance with a second embodiment of the invention.

As shown for instance in FIG. 6, the reinforcing element C2 may also comprise an extension portion 10*b* protruding radially outwards relative to the reinforcing portion 10. This extension portion 10*b* is here used as a label part that can extend above the upper portion 3*c* of the body 3 as shown in FIG. 2. The extension portion 10*b* may have a generally rectangular shape or similar elongated shape. Although FIG. 6 illustrates an extension portion 10*b* fixed to the margin portion 6*b* of the closing element C1, it is understood that such an extension portion 10*b* may be arranged as a free portion protruding beyond the closing element C1.

Referring to the examples of FIGS. 1 and 3-4, the pull tab 9 may be of generally rectangular shape. The width (smaller size w) of the rectangular shape is measured in a direction parallel to the radial direction R. The length (larger size d) of the rectangular shape is measured in a direction perpendicular to this radial direction R. It is advantageous to stick the closing element C1 and the reinforcing element C2 together for a quick removing of the cover member C (removed as one block). Such a configuration is suitable to minimize amount of plastic material of the cover member C, and label information may be easy read in the periphery of the cover member C (for instance a capacity of the bottle 1 or the name of the content may be printed on the pull tab 9 and/or on the optional extension portion 10*b*).

Optionally, the pull tab 9 is provided with a single outer edge E which is continuous, this outer edge E having a length superior or equal to one half of the diameter D2 here defined by the reinforcing element C2. This outer edge E is typically C-shaped as shown for instance in FIG. 3 so that no sharp edge is provided in the pull tab 9. Referring to FIGS. 1 and 3-4, it can be seen that the top surface S3 defined by the pull tab 9 is entirely offset relative to the upper face F of the neck 4; The ratio between this top surface S3 and the first surface S1 defined by the reinforcing portion 10 is here superior to 1:15 and inferior to about 1:3. This ratio is for instance comprised between 1:10 and 1:4.

A rim of the free end 9*a* forms a part of the C-shaped outer edge E and may be rectilinear so as to elongate and optimize the top surface S3 used for a label L with a minimum of plastic material. The top surface S3 is thus close from the free end 9*a*.

The reinforcing portion 10 taken as a whole or a part thereof (for instance a central part) may also be used as a label, allowing display of information related to the composition and origin of the content or other relevant information. In the second embodiment as shown in FIG. 6, the free end 9*a* of the pull tab 9 extends at a distance from the label part defined by the extension portion 10*b*, preferably in the opposite region. In this case, the extension portion 10 does not reinforce the optional pull tab 9.

It can be seen in the figures that the outer shape of the reinforcing element C2 does not necessarily correspond to the cut of the margin portion 6*b* of the closing element C1 so that at least a fraction of the margin portion 6*b* can be quickly identified as different from a label area defined on the reinforcing element C2 and can be used as pull tab 9. Possibly, the pull tab 9 is specifically coloured in a distinct manner with respect to the central portion 6 which is preferably uncoloured and/or transparent. In another embodiment, the closing element C1 can be made of a transparent or colourless plastic material while the film defining the reinforcing element C2 is opaque or coloured respectively, thus increasing the visual contrast between the pull tab 9 and the reinforcing element C2. In a variant, an extension portion 10*b* may be provided to cover the pull tab 9 and it may be specifically coloured and/or marked to allow quick identification of the pull area of the cover member C. It is noted that the film-like closing element C1 is not reinforced by itself since the closing element C1 is a plastic film (i.e. a metal-free film). The reinforcing element C2 thus compensates high flexibility of the film-like closing element C1, while the uncovered parts (for instance a pull tab 9) of the closing element C1 remain deformable. The reinforcing element C2 is also a plastic film and, preferably, similar or identical materials are used in the two elements C1 and C2.

In the first embodiment shown in FIGS. 1-4 and in the respective variants of FIGS. 6, 7 and 8 as well, the reinforcing element C2 or the reinforcing portion 10 thereof (when an extension portion 10*b* is provided) defines a substantially disc-shaped crown having a determined diameter D2. The inner diameter D5 of the opening is inferior to this diameter D2 and the annular fixing portion 6*a* of the central portion 6 is preferably continuously covered by the reinforcing portion 10 that creates an additional layer of material, thus stiffening and reinforcing the central portion 6. FIG. 7 illustrates a ring-like reinforcing portion 10 that defines an opening 10*a* (thus saving material). The reinforcing portion 10 may be directly fastened to all or a part of the support surface S0. The reinforcing portion 10, when shaped as a ring in particular, partly covers the central portion 6. This variant of FIG. 7 also illustrates a generally rectangular or squared shape for the closing element C1, with at least two rounded corners.

Referring to FIG. 6, it can be seen that the reinforcing portion 10 may be of smaller size than the ring 4*a* of the neck 4, so as to save material. In this case, the reinforcing portion 10 also covers (but partly) the ring 4*a*. This ensures that the opening 5 and the associated surround of the ring 4*a* are successively covered by the central portion 6 of the closing element C1 and by the reinforcing portion 10 of the reinforcing element. Of course, a reinforcing portion 10 with such a size may be used in any one of the other embodiments shown in the figures.

Referring to FIGS. 3, 4 and 7, the reinforcing element C2 only comprises the reinforcing portion 10 and is rounded. The first surface S1 is delimited by an outer rim 8 which is here generally circular and defines the perimeter of the reinforcing element C2. This first surface S1 may be optionally used to display information. In the second embodiment shown in FIG. 6, the outer rim 8 of the reinforcing element C2 is longer than the perimeter of the reinforcing portion (the circumference of the reinforcing portion 10 being here circular) because of the extension portion 10*b*. This extension portion 10*b* defines a second surface S2 that is entirely offset relative to the upper face F of the neck 4. The ratio between the second surface S2 and the first surface S1 is less than 1:2, preferably inferior to 1:5 and superior to 1:15. In other words, the extension portion 10*b* of the reinforcing element C2 does not extend far beyond the limits of the ring 4*a* so as to reduce the amount of material. In the embodiments without any extension portion 10*b*, the above indicated ratio is equal to zero.

As shown in FIG. 6, the optional extension portion 10*b* has two corners and defines a second surface S2, where label information is marked. This second surface S2 is entirely offset relative to the annular area defined by the annular fixing portion 6*a*. Accordingly, adequate visibility of the label information is obtained once the cover member C is fixed by the central portion 6 onto the top of a liquid filled bottle 1. The rectilinear short sides y1, y2 of the extension portion 10*b* extend each from the outer rim 8 to the free edge 12 of the extension portion 10*b*.

Preferably, the larger size of the extension portion 10*b* (corresponding to the length of the free edge 12) is not inferior to the half of the diameter D2. It can be seen that when the second surface S2 for the label is rectangular, the length of the free edge 12 is measured according to a direction perpendicular to the longitudinal axis A and perpendicular to the radial direction R.

It can be seen in FIG. 6 that the extension portion 10*b* may define a label formed as a side extension of the reinforcing element C2 and the spacing between the rounded outer rim of the reinforcing portion 10 and the rounded parts of the circumference 7 remains small, for instance with a spacing inferior or equal to 4 mm. The circumference 7 is preferably rounded as the outer rim 8 as shown in FIGS. 1 and 3-4. In the first embodiment, the sector with the rounded circumference is here of at least 270° (the pull tab 9 corresponding to a sector of less than 90°).

The closing element C1 is a peelable film having a thickness inferior or equal to 300 μm and preferably inferior or equal to 150 or 200 μm, and more preferably not superior to 100 μm. The closing element C1 is sufficiently resistant to be pulled without any deterioration. The flexible reinforcing element C2 may advantageously be substantially as thin as or thinner than the closing element C1, for instance when the closing element C1 has a thickness between 50 and 150 μm, and is preferably inferior or equal to 100 μm. For instance, the thickness of the reinforcing element C2 is about 50 μm, thus defining a very thin sticker. The reinforcing element C2 may be of a slightly higher thickness when these elements C1-C2 are provided with a thickness significantly inferior to 100 μm. Of course, the closing element C1 may have a thickness inferior to the thickness of the reinforcing element C2. As a way of example, the closing element C1 can have a constant thickness comprised between 5 and 200 μm, and preferably between 10 and 100 μm. For instance, this thickness is about 36 μm. There is no particular need for any other additional reinforcing layer in the preferred embodiments. It is understood that any accidental perforation of the closing element C1 can be suitably prevented when the reinforcing portion 10 is at least sized as the opening 5. The reinforcing element C2 may be applied as a sticker that adheres on the closing element C1. Preferably, the reinforcing portion 10 is provided with an adhesive thereon for attachment onto the support surface S0 of the closing element C1. The optional extension portion 10*b* may also adhere to the pull tab 9 of the closing element C1 when the pull tab 9 extends in the same direction.

As shown in FIGS. 1-4 and 6-7, the reinforcing portion 10 of the multilayer film or similar film that defines the reinforcing element C2 can be centered with respect to the longitudinal axis A and has here a diameter D2 or similar characteristic dimension significantly inferior to the diameter D1 or similar characteristic dimensions of the body 3. The quantity of material for making the reinforcing portion 10 is thus minimized as compared to the capacity of the bottle 1. Of course, it will be appreciated that the respective thicknesses of the closing element C1 and of the reinforcing element C2 have been enlarged in FIG. 2 for a better representation.

In the non-limitative example of the figures, the single piece reinforcing element C2 is here marked with ink printing or any other marking technology on the first surface S1 that corresponds to an upper face of the reinforcing portion 10 and preferably also on an additional surface S1' that corresponds to a lower face of the reinforcing portion 10.

In FIG. 1, it can be seen that the front or upper face of at least the reinforcing portion 10 of the reinforcing element C2 may be partitioned into different areas (subareas of the first surface S1), for instance at least one area with alphanumeric, pictograms and/or pictorial information and at least one area with coded information (for instance displaying a barcode 20). Similarly, the additional surface S1' may be partitioned in a similar manner. Such a partitioning may be used in each of the illustrated embodiments, as for instance in the variant of FIG. 6.

When fixed, the cover member C will be capable of containment of pressures which may be produced in the bottle 1 above the liquid 15 while enabling facile opening of said cover member C by pulling the pull tab 9 in a movement generally parallel to the longitudinal axis A. Referring to the embodiment of FIG. 6, as the extension portion 10*b* is here smaller or not larger than the pull tab 9, risk of only removing the label element C2 is prevented.

Figure 9A:
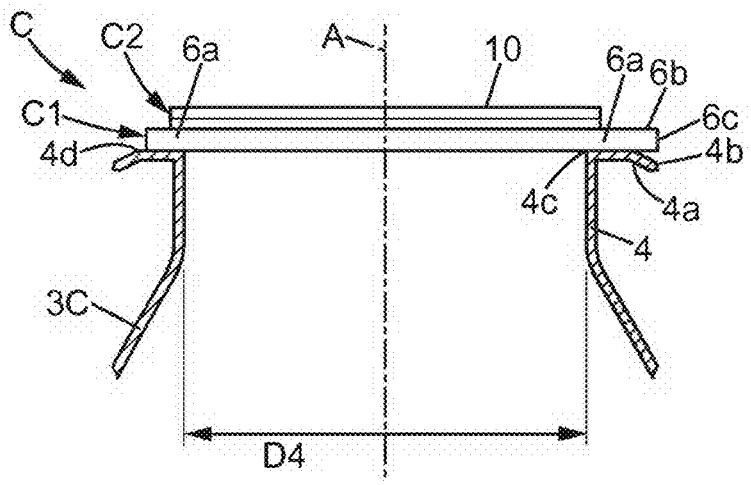
FIGS. 9A and 9B show an upper part of the bottle in a variant as compared to FIG. 2.

More generally, the pull tab 9 may be considered as an option. Referring to FIG. 9A, it can be seen that the closing element C1 may be provided without any particular pull tab 9. A margin portion 6*b* may be provided with a free end 6*c* not fixed to the ring 4*a*. Here the free end 6*c* is not offset relative to the upper face F of the neck 4 and a peripheral portion 4*b* of the ring 4*a* is angled. The ring 4*a* comprises a substantially planar upper surface portion of annular shape configured to contact the closing element C1 and a peripheral surface, preferably of annular shape, extending radially outward around the planar surface portion and downwardly (i.e. toward the bottom 2 of the bottle). With this angled or curved configuration, there is a space between the ring 4*a* and the free end 6*c* which is suitable to facilitate a tearing action on the free end 6*c* in order to remove the cover member C.

In the embodiment shown in FIG. 9A, the reinforcing effect is obtained as the annular fixing portion 6*a* that covers the ring 4*a* is sandwiched between the reinforcing portion 10 and the ring 4*a*. The wording "covers the ring 4*a*" means that at least the inner rim 4*c* of the ring 4*a* is completely covered to obtain the sealing and there is of course no requirement for a full coverage of the whole upper surface of the ring 4*a* (which may be partly radially covered as shown in FIG. 9A for instance).

Figure 9B:
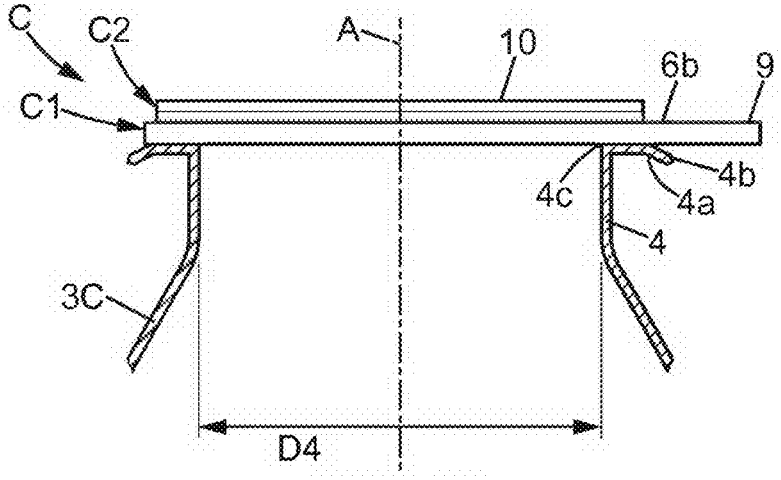

Referring to FIG. 9B, the closing element C1 may completely cover the planar upper surface portion of the ring defined between the inner rim 4*c* and the annular rim 4*d*. Such a configuration of the closing element C1 with a pull tab 9 may be advantageously chosen when an improved fixation is provided between the cover member C and the ring 4*a*. In such as case, the pull tab 9 greatly facilitates the removal of the peelable cover member C. More generally, it is understood that the angled or curved configuration of the ring 4*a* provided with the peripheral portion 4*b* may be used in combination with any of the other illustrated embodiments.

The tensile strength of the plastic film (i.e. metal free film) used for making the closing element C1 may be comprised for instance between 40 and 300 N/m$^2$, preferably between 50 and 200 N/m$^2$. The reinforcing element C2 that optionally comprises a label defined in the protruding portion 9 and the reinforcing portion 10 to be fixed as a top portion onto the top of the closing element C1 is integrally formed in bendable plastic film (i.e. metal free film). The plastic film may be obtained using a flexible multilayer sheet plastic so that both faces of the reinforcing portion 10 may be marked with information, for instance by ink printing.

Figure 8A:
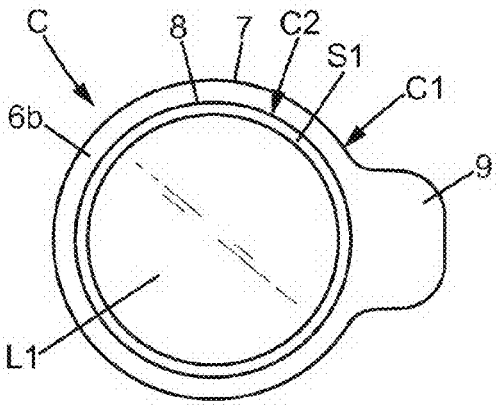
FIG. 8A is a top view of a cover member covering a liquid filled bottle in accordance with a third embodiment of the invention.
Figure 8B:
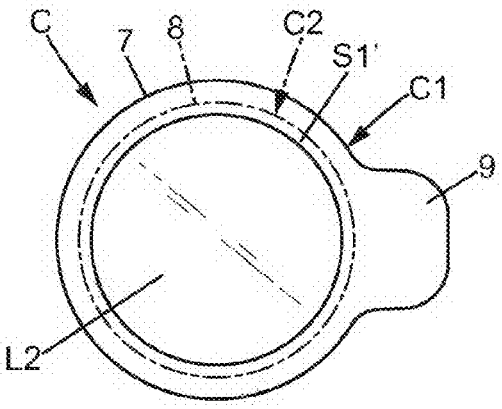
FIG. 8B is a bottom view of the cover member of FIG. 8A.

According to a third embodiment as illustrated in FIGS. 8A-8B, respective surfaces S1, S1' of the reinforcing element C2 are provided with label information L1 and L2. Of course, such label information L1, L2 may be produced with any other embodiments of the invention and label information L1 may be provided in an area as large as the disk-shaped first surface S1. Optionally, the outer shape of this label information area may differ from the outer shape of the first surface S1. FIG. 8B shows the other face of the cover member C, where label information L2 is displayed when watching the lower face of the reinforcing portion 10. Such label information L2 can be seen because of the transparency of the closing element C1.

With such a configuration of the cover member C, a liquid filled bottle 1 may be provided without any specific additional label and only with label information L1 displayed from the cover member C at the first surface S1 (and optionally with label information M marked on the top surface S3 of the pull tab 9). As a result, with a body 3 made of a transparent plastic material as shown in FIGS. 2 and 5, the liquid 15 is entirely visible through the walls of the body 3. In other words, the body 3 is not covered by any additional layer of material and a bottle can be produced with one step less. Should a need exist for adding more information, a conventional sleeve label (not shown) may be added.

Referring to FIGS. 1, 3-4, 6-8, it should be understood that the bigger dimension of the pull tab 9 may be about 6-12 mm. Preferably, the pull tab 9 is wider than long. Accordingly, the cover member C has a compact shape with a maximum size not in excess of more than 30% with respect to the diameter D2 or similar characterising size of the reinforcing portion 10.

As shown in the first embodiment, the reinforcing portion 10 and the central portion 6 can have a circular shape or the like. In the closing element C1, the outer diameter of the annular fixing portion 6*a* (delimiting the central portion 6) is here slightly superior to the diameter D5 of the opening 5. The diameter D5 can be typically of higher than 12 mm, preferably higher than 15 mm, for example from 15 to 20 mm or from 20 mm to 25 mm, or from 25 to 30 mm. The annular area defined by the annular fixing portion 6*a* can have a width of from 1 to 15 mm, preferably from 2 to 10 mm, preferably from 2.8 to 5 mm. The outer diameter of the annular fixing portion 6*a* can be of higher than 15 mm, preferably of higher than 20 mm, for example of from 20 to 23 mm, or of from 23 to 25.5 mm, or of from 25.5 to 27.5 mm, or of from 27.5 mm to 30 mm, or of from 30 mm to 35 mm. The fixing annular area 6*a* thus can have an outer perimeter higher than about 45 mm, preferably of higher than 60 mm. A large width can be useful in making the fixing easier. Preferably, a minimum spacing between 0.5 and 2 mm, typically of about 1 mm, is provided between the outer rim 8 of the reinforcing portion 10 and the outer rim of the closing element C1.

The present invention has been described in connection with the preferred embodiments. These embodiments, however, are merely for example and the invention is not restricted thereto. It will be understood by those skilled in the art that other variations and modifications can easily be made within the scope of the invention as defined by the appended claims, thus it is only intended that the present invention be limited by the following claims. Of course, the bottle 1 is not in any way limited to flat or sparkling mineral water but can be intended to contain all sorts of flowable products, edible or inedible liquids of greater or lesser fluidity such as, for example, fruit juices, milk-based beverages such as milk or dairy fermented products (for example yogurts), etc., and also sauces or condiments (ketchup, mustard, dressing, etc.) or non-food liquids (deionised water, cleaning products, detergents, etc.). The term "liquid" should thus not be interpreted in a restricted manner as the plastic container could be filled with any flowable product. Also, the size of the restricted aperture of the bottle 1 may be adjusted.

While the illustrated embodiments show a closing element C1 having a greater surface than the reinforcing element C2, in particular when the reinforcing element C2 has a continuously rounded outer rim, it should be understood that the reinforcing element may comprise an extension portion 10*b* (for instance of annular shape) slightly protruding outwards with respect to the closing element C1.

Any reference sign in the following claims should not be construed as limiting the claim. It will be obvious that the use of the verb "to comprise" and its conjugations does not exclude the presence of any other elements besides those defined in any claim. The word "a" or "an" preceding an element does not exclude the presence of a plurality of such elements.

The invention claimed is:

1. A liquid filled bottle, comprising a cover member and a plastic bottle having a body, a rigid neck and a narrow opening sealed by the cover member, the narrow opening being defined in the upper face of the neck and surrounded by a ring of the neck, the cover member comprising:

a one piece flexible closing element consisting essentially of a peelable film and comprising a central portion adhering with said ring and sealing the narrow opening of the bottle, and a one piece flexible reinforcing element defined by at least one layer of film material;

wherein the closing element has a top face delimited by a circumference and defining a planar support surface;

wherein the reinforcing element comprises a reinforcing portion directly fastened to all or a part of the support surface and which entirely or partly covers said central portion, with the provision that at least an annular fixing portion covering the ring is covered by the reinforcing element, the reinforcing portion defining a first surface, wherein the first surface is delimited by an outer rim of the reinforcing element, the outer rim extending annularly close to the ring, wherein the outer rim of the reinforcing element has a length inferior to said circumference and extends within the circumference of the closing element, and wherein the closing element comprises a pull tab adapted for removing the cover member from the ring of the neck, the pull tab protruding radially outward beyond the ring, the pull tab defining a top surface which is entirely offset relative to the upper face of the neck, the ratio between the top surface and the first surface being inferior to 1:3 and superior to 1:15.

2. The liquid filled bottle according to claim 1, wherein the outer rim of the reinforcing element is continuously rounded.

3. The liquid filled bottle according to claim 1, wherein the reinforcing element defines a label with label information displayed on at least one of:

the first surface which corresponds to an upper face of the reinforcing portion; and an additional surface which corresponds to a lower face of the reinforcing portion.

4. The liquid filled bottle according to claim 1, wherein the body of the bottle extends around a longitudinal axis and the narrow opening is circular and provided with an inner diameter, the pull tab comprising a free end and the distance between said free end and the longitudinal axis being inferior to the inner diameter.

5. The liquid filled bottle according to claim 1, wherein the closing element is a plastic film.

6. The liquid filled bottle according to claim 1, wherein the closing element is a peelable film having a thickness inferior or equal to 300 μm.

7. The liquid filled bottle according to claim 6, wherein the reinforcing element has a thickness inferior or equal to 100 μm.

8. The liquid filled bottle according to claim 6, wherein the closing element has a thickness, which is constant and is comprised between 5 and 200 μm.

9. The liquid filled bottle according to claim 1, wherein the neck has a tubular shape and comprises an outer face extending downwardly from the ring, the ring protruding radially outwards from the outer face.

10. A liquid filled bottle, comprising a cover member and a plastic bottle having a body, a rigid neck and a narrow opening sealed by the cover member, the narrow opening being defined in the upper face of the neck and surrounded by a ring of the neck, the cover member comprising:

a one piece flexible closing element consisting essentially of a peelable film and comprising a central portion adhering with said ring and sealing the narrow opening of the bottle, and a one piece flexible reinforcing element defined by at least one layer of film material;

wherein the closing element has a top face delimited by a circumference and defining a planar support surface;

wherein the reinforcing element defines a substantially disc-shaped crown having a determined diameter, the reinforcing element comprising a reinforcing portion directly fastened to all or a part of the support surface and which entirely or partly covers said central portion, with the provision that at least an annular fixing portion covering the ring is covered by the reinforcing element, the reinforcing portion defining a first surface, wherein the first surface is delimitated by an outer rim of the reinforcing element, the outer rim extending annularly close to the ring, wherein the outer rim of the reinforcing element has a length inferior to said circumference and extends within the limits of said circumference of the closing element, and wherein the closing element comprises a pull tab adapted for removing the cover member from the ring of the neck, the pull tab protruding radially outwards beyond the ring, the pull tab comprising an outer edge having a length superior or equal to one half of said determined diameter.

11. The liquid filled bottle according to claim 1, wherein the bottle is obtained by stretch-blow molding an injection-molded preform, the body being connected to the rigid neck of the bottle by a flexible shoulder, and wherein the bottle comprises one label defined by the reinforcing element, the body being transparent and not covered by any additional layer of material.

12. The liquid filled bottle according to claim 1, wherein the central portion of the closing element is fixed on the ring of the neck by heat sealing.

13. The liquid filled bottle according to claim 1, wherein the closing element is a one piece plastic element.

14. The liquid filled bottle according to claim 7, wherein the thickness of the reinforcing element is superior to the thickness of the closing element.

15. The liquid filled bottle according to claim 8, wherein the thickness of the closing element is comprised between 10 μm and 100 μm.

16. The liquid filled bottle according to claim 1, wherein the cover member comprises at least one margin portion extending around the central portion.

17. A liquid filled bottle, comprising a cover member and a plastic bottle having a body, a rigid neck and a narrow opening sealed by the cover member, the narrow opening being defined in the upper face of the neck and surrounded by a ring of the neck, the cover member comprising:

a one piece flexible closing element consisting essentially of a peelable film and comprising a central portion adhering with said ring and sealing the narrow opening of the bottle, and a one piece flexible reinforcing element defined by at least one layer of film material;

wherein the closing element has a top face delimited by a circumference and defining a planar support surface;

wherein the reinforcing element comprises a reinforcing portion directly fastened to all or a part of the support surface and which entirely or partly covers said central portion, with the provision that at least an annular fixing portion covering the ring is covered by the reinforcing element, the reinforcing portion defining a first surface, wherein the first surface is delimitated by an outer rim of the reinforcing element, the outer rim extending annularly close to the ring, and wherein the outer rim of the reinforcing element has a length inferior to said circumference, the reinforcing element comprising an extension portion defining a second surface that is entirely offset relative to the upper face of the neck, with the provision that the ratio between the second surface and the first surface is lower than 1:2.

18. A liquid filled bottle, comprising a cover member and a plastic bottle having a body, a rigid neck and a narrow opening sealed by the cover member, the narrow opening being defined in the upper face of the neck and surrounded by a ring of the neck, the cover member comprising:

a one piece flexible closing element consisting essentially of a peelable film and comprising a central portion, the central portion adhering with said ring and sealing the narrow opening of the bottle, and a one piece flexible reinforcing element defined by at least one layer of film material;

wherein the closing element has a top face delimited by a circumference and defining a planar support surface;

wherein the reinforcing element comprises a reinforcing portion directly fastened to all or a part of the support surface and which entirely or partly covers said central portion, with the provision that at least an annular fixing portion covering the ring is covered by the reinforcing element, the reinforcing portion defining a first surface, wherein the bottle is obtained by stretch-blow molding an injection-molded preform, the body being connected to the rigid neck of the bottle by a flexible shoulder, and wherein the bottle comprises one label defined by the reinforcing element, the body being transparent and not covered by any additional layer of material.

* * * * *